United States Patent [19]

Ellis et al.

[11] Patent Number: 4,901,968

[45] Date of Patent: Feb. 20, 1990

[54] BASS BOAT SEAT BRACKET

[76] Inventors: John W. Ellis; John W. Ellis, Jr., both of P.O. Box 48, Pensacola, Fla. 32591

[21] Appl. No.: 310,692

[22] Filed: Feb. 15, 1989

[51] Int. Cl.[4] ..... B60N 1/02

[52] U.S. Cl. ..... 248/407

[58] Field of Search ..... 248/599, 600, 601, 622, 248/623, 161, 407, 408, 409, 415, 157, 423; 108/44, 146, 144, 150; 297/345, 349

[56] References Cited

U.S. PATENT DOCUMENTS

| | | | |
|---|---|---|---|
| 955,349 | 4/1910 | O'Brien | 248/407 |
| 1,013,265 | 1/1912 | Applas | 297/349 |
| 1,164,909 | 12/1915 | Auberlin . | |
| 1,445,090 | 2/1923 | Kotun | 108/150 |
| 2,672,915 | 3/1954 | Jones | 248/601 |
| 2,748,261 | 5/1956 | Wolar | 248/407 |
| 3,179,071 | 4/1965 | Johnston | 108/144 |
| 3,469,870 | 9/1969 | Barkus | 108/150 |
| 3,642,320 | 2/1972 | Ward | 297/345 |
| 4,279,398 | 7/1981 | Pregnall | 248/405 |
| 4,587,921 | 5/1986 | Currey . | |

FOREIGN PATENT DOCUMENTS

| | | | |
|---|---|---|---|
| 818911 | 7/1969 | Canada | 248/415 |
| 2341517 | 10/1974 | Fed. Rep. of Germany | 248/407 |
| 129517 | 12/1928 | Switzerland | 248/601 |
| 1039642 | 8/1966 | United Kingdom | 297/349 |
| 1423130 | 1/1976 | United Kingdom | 248/601 |

*Primary Examiner*—Ramon O. Ramirez
*Assistant Examiner*—Robert A. Olson
*Attorney, Agent, or Firm*—John K. Donaghy

[57] ABSTRACT

A vertically extensible seat bracket assembly for fishing boats or the like, characterized in that most of the assembly mounts below the boat deck when in this lowered position, the seat may be raised and locked in its elevated position with a simple lift-and-twist motion. The seat mount assembly includes a shock absorbing spring, as well as a feature which allows easy removal of the seat for storage while the major portion of the seat bracket assembly remains below the boat deck.

4 Claims, 4 Drawing Sheets

FIG. 1
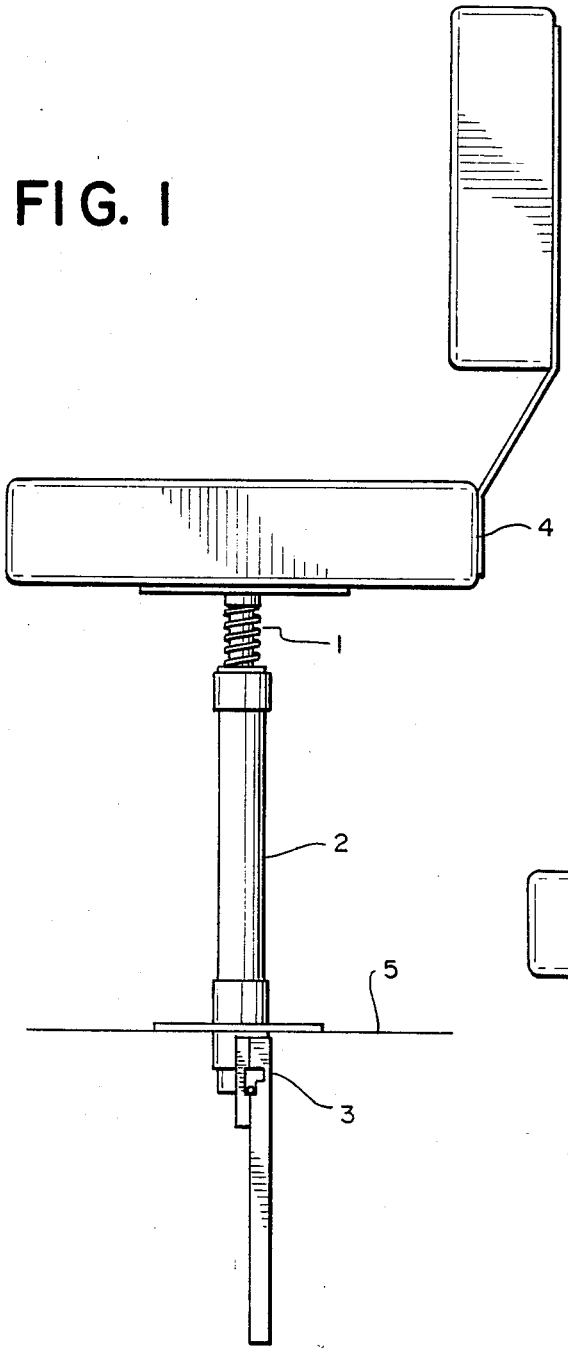
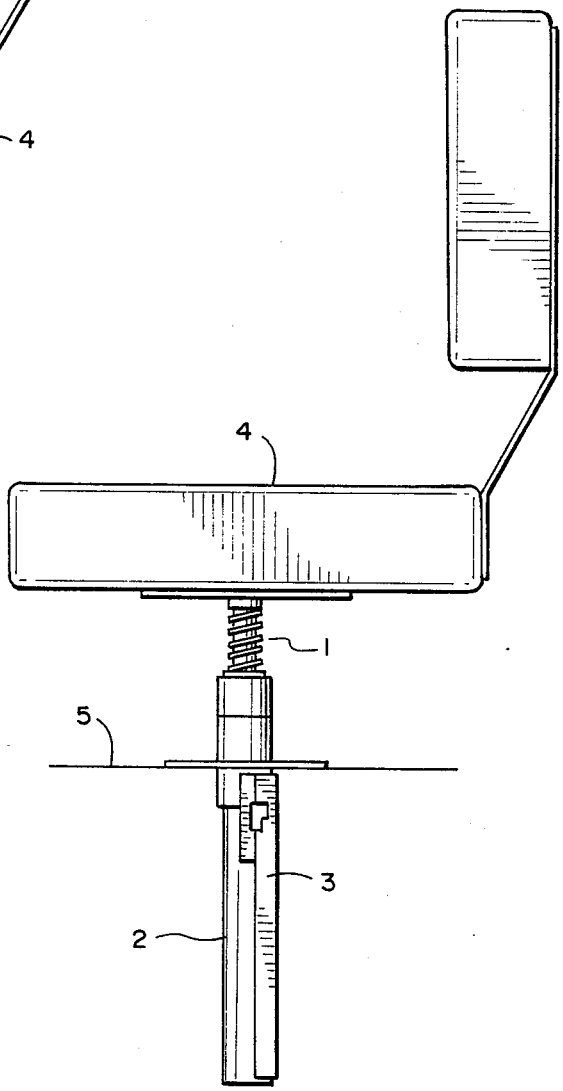
FIG. 2

FIG. 5A
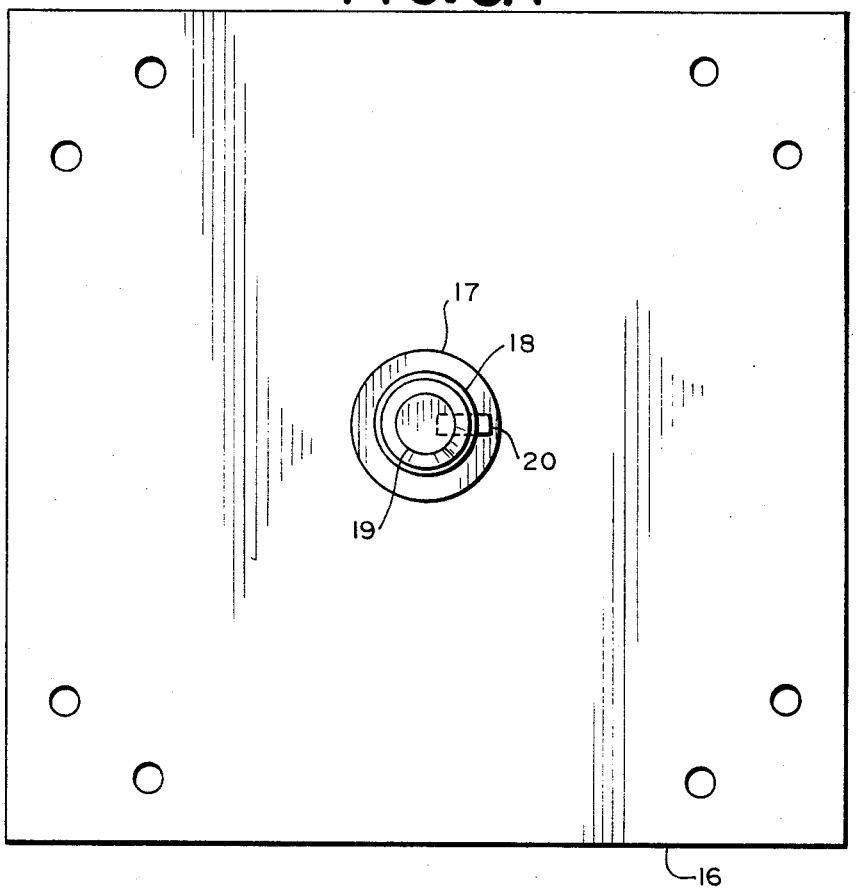
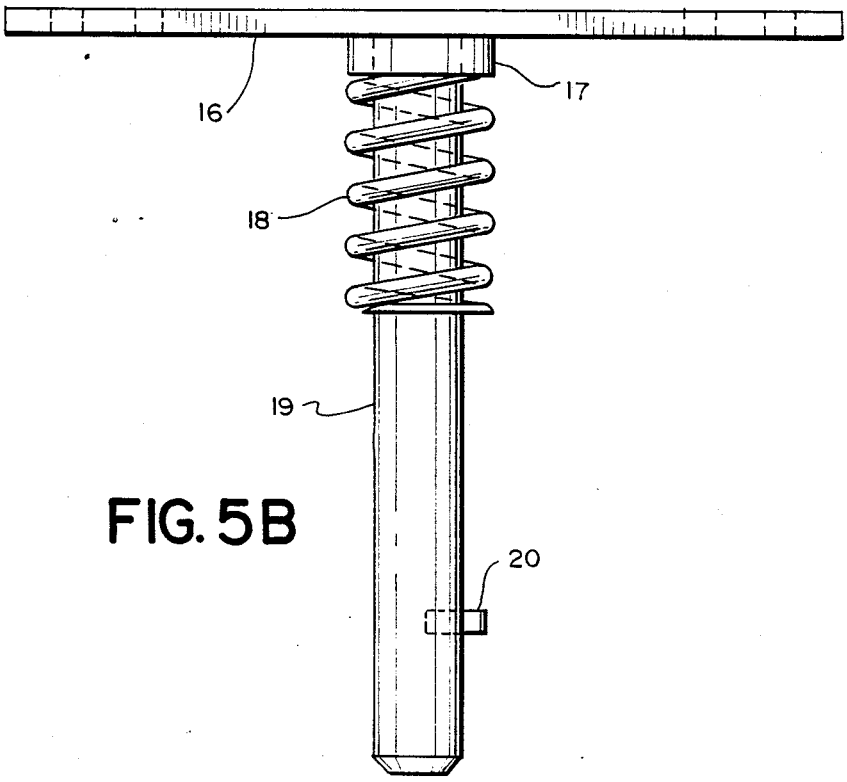
FIG. 5B

BASS BOAT SEAT BRACKET

BACKGROUND OF THE INVENTION

1. Field of the Invention

This invention relates to a seat bracket for use in certain boats designed specifically for inland water fishing, and commonly called bass boats. These boats are designed for fishing on still waters such as lakes, where the boat remains relatively stable, and the best fishing platform is a swivel seat mounted on a tall pedestal, thus affording the fisherman a view of the entire area surrounding the boat, and placing him high enough above the boat deck and gunwales to allow unimpeded casting in any direction.

A second feature of bass boats is their ability to travel from one fishing spot to another at great speed. In order to accomplish this, the operator of the boat must sit at the rear near the outboard motor, and he must be able to see forward to keep the boat headed in the proper direction, avoiding obstacles along the way. Unfortunately, the ideal bass boat seat will be directly in his line of sight.

2. Description of the Prior Art

Prior art bass boat seats were simply positioned low in the boat so that the operator could see over them during operation of the craft from one location to the other. Thus the seat was placed at a lower-than-desirable position.

While vertically adjustable boat seats are available, such as those shown in U.S. Pat. Nos. 4,279,398 to L. W. Pregnall and 3,642,320 to M. K. Ward, all of the hardware for such seats mounts above the boat deck, and thus even at their lowest positions, these seats are still too high to meet the needs of the bass boat fisherman.

SUMMARY OF THE INVENTION

The bass boat seat bracket of the instant invention is designed such that the vertical seat support shaft is stored below the boat deck, and thus the seat itself may be lowered almost flush with the deck, completely out of the operator's line of sight. Once the fishing spot is reached, and the boat stops, the seat may be easily raised to an elevated position and latched there, providing the ideal elevated platform for the fisherman. Additionally the seat may be removed from the telescoping bracket altogether, for storage between outings or the like, and the retractable vertical support bracketry will remain in place in the boat deck.

BRIEF DESCRIPTION OF THE DRAWINGS

FIG. 1 is a side plan view of the seat bracket of the invention in its elevated, fishing position.

FIG. 2 is a side plan view of the seat bracket of the invention in its lowered, running position.

FIGS. 5A and 5B are bottom plan and front plan views of the seat mount assembly of the invention.

DETAILED DESCRIPTION OF THE PREFERRED EMBODIMENT

Figure 3A:
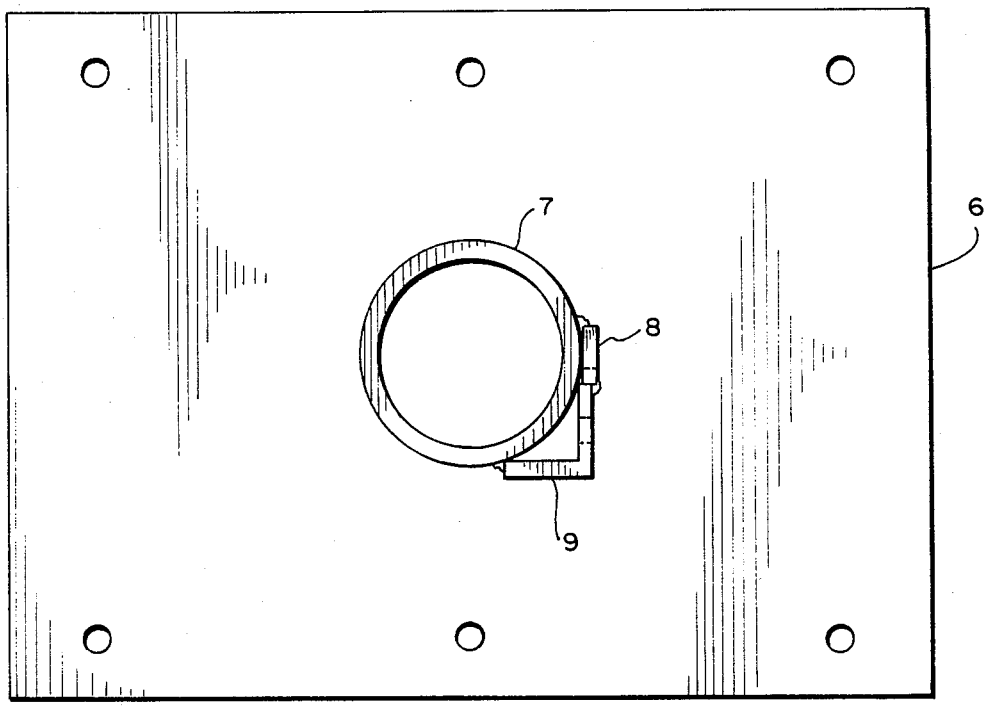
FIGS. 3A and 3B bottom plan and side plan views of the deck mounting assembly of the invention.

The bass boat seat bracket of the present invention has three major components, as illustrated in FIG. 1: the seat mount assembly 1, support shaft assembly 2, and deck mount assembly 3. FIGS. 1 and 2 show a standard boat seat 4 secured to the seat mount assembly 1 of the invention in both the elevated, fishing position and the lowered, running position, respectively. Deck mount assembly 3 is shown secured to boat deck 5 with a substantial portion of deck mount 3 extending below deck 5.

Figure 3B:
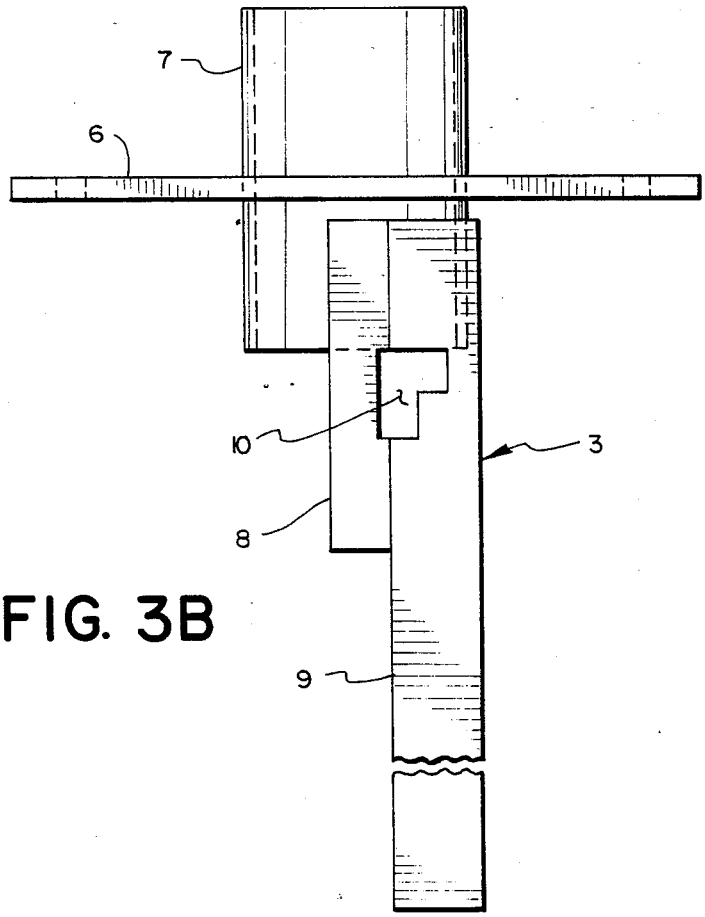

Referring to FIG. 3A and 3B, deck mount assembly 3 includes boat deck mounting plate 6, support tube 7, flat bar 8 and angle guide 9. Support tube 7 is welded in a like-sized aperture in the center of boat deck mounting plate 6, with equal portions of tube 7 extending above and below plate 6. To the underside of plate 6 are welded angle guide 9 and flat bar 8. The guide 9 is welded to both the plate 6 and tube 7, and extends downwardly from plate 6 parallel to the axis of tube 7. A lock notch 10 is cut or ground into one side of guide 9 near its upper end, just below the lower end of tube 7, and the open side of notch 10 is closed off by welding flat bar 8 to both the notched side of guide 9 and the lower portion of tube 7.

Figure 4C:
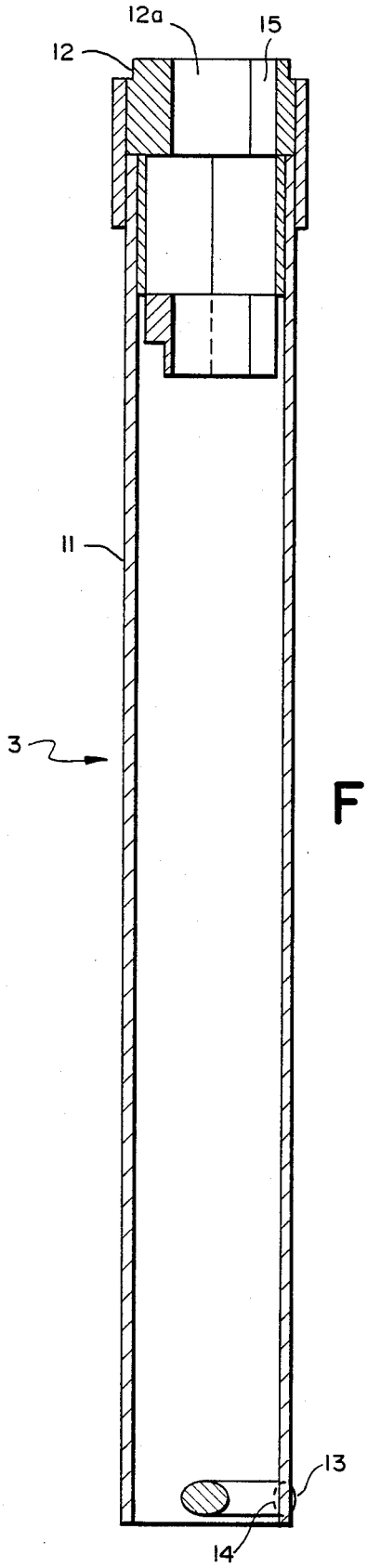
FIG. 4A, 4B and 4C are top plan, bottom plan and side sectional views of the vertical seat support shaft of the invention.
Figure 4A:
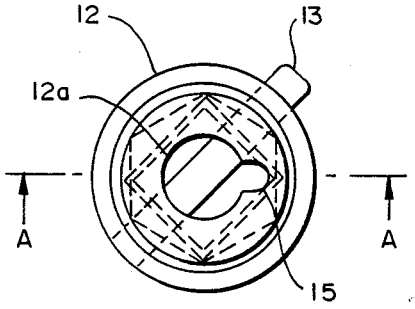
Figure 4B:
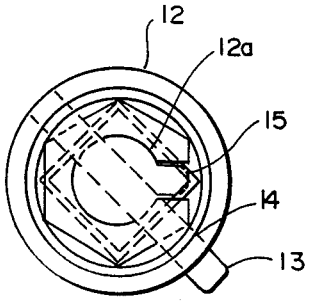

Support shaft assembly 3, as illustrated in FIGS. 4A, 4B and 4C, is comprised of elongate tubular support shaft 11 and pin guide assembly 12. Support pin 13 is inserted across the diameter of shaft 11 through an aperture 14 in the lower end thereof, with a portion of the pin 13 extending exteriorly of shaft 11 to engage lock notch 10 of deck mount assembly 3 to hold the seat bracket in its elevated position, as will be described in detail subsequently. Pin guide assembly 12 extends approximately two inches into the top of shaft 11, and includes a small central aperture 12*a* extending the length of the pin guide, with a similarly extending notch 15 in one side thereof.

FIGS. 5A and 5B show seat mount assembly 1, comprised of a seat mounting plate 16, coupling collar 17, shock absorbing spring 18, seat guide shaft 19 and seat guide pin 20. Collar 17 and shaft 19 are welded to the center of the bottom of seat mounting plate 16, with shaft 19 extending perpendicular therefrom. The upper coil of shock absorbing spring 18 is tack-welded to collar 17, with seat guide shaft 19 extending through the central axis of the spring and acting as a guide therefor. Seat guide pin 20 is press-fit into an aperture near the bottom end of guide shaft 19, with a portion of the pin extending beyond the side of the shaft.

Installation and operation of the bass boat seat bracket are described as follows: A hole is cut in boat deck 5 large enough to allow insertion of angle guide 9, flat bar 8 and support tube 7 of deck mount assembly 3. Once this is accomplished, boat deck mounting plate 6 is secured to deck 5 by appropriate fasteners through the six holes provided therein.

Support pin 13 is then removed from support shaft assembly 3, and the assembly is inserted through support tube 7. As aperture 14 passes lock notch 10 beneath the boat deck, pin 13 is reinserted into aperture 14. If the pin 13 is then aligned with the corner of angle guide 9, support shaft assembly 3 may be recessed to its running position, with pin guide assembly 12 abutting the upper edge of support tube 7.

Seat mount assembly 1 is secured to any standard seat 4 by appropriate fasteners through the eight holes provided in seat mounting plate 16. Then seat guide pin 20 is aligned with notch 15 in pin guide assembly 12, and seat guide shaft 19 is inserted fully into central aperture 12*a* of assembly 12, until spring 18 contacts the top of assembly 12. It is apparent that once pin 20 passes completely through notch 15 and thus pin guide assembly 12, seat mount assembly 1 will allow full 360° rotation of seat 4. Shock absorbing spring 18 will provide a modicum of comfort during rough rides, and by aligning pin 20 with notch 15 again, the entire seat assembly may be removed for storage or the like.

Once one has reached a favorite fishing spot, the entire seat assembly may be lifted, extending support shaft assembly 3 until support pin 13 contacts the lower end of support tube 7. This position automatically aligns pin 13 with lock notch 10, and a simple twist of the seat assembly in the direction of flat bar 8 will allow pin 13 to be dropped into the lower portion of lock notch 10 in angle guide 9, which is the locked, elevated position for support shaft assembly 3. The seat 4 is now elevated to the desirable fishing position, and capable of full 360° rotation.

When the fisherman is ready to start the boat and move on to another location, he simply pulls up on the seat assembly to raise pin 13 from its locked position in lock notch 10, turns the support shaft assembly 3 in a direction opposite flat bar 8 to align it with the corner of angle guide 9, and support shaft assembly 3 may be lowered into its fully retracted position for travel.

This detailed description of the preferred embodiment of the present invention and the specific apparatus describe herein may of course be modified or changed in the design, construction or materials thereof without departing from the spirit and scope of this invention, which is limited only by the appended claims.

I claim:

1. In combination with a boat deck, a vertically adjustable seat bracket for fishing boats, comprising:

a deck mount assembly for securement to said boat deck, a substantial portion of said deck mount extending below said deck;

a seat support shaft assembly received telescopingly within said deck mount assembly such that said shaft will disappear within said deck mount and below said boat deck when in a lower, retracted position;

and a seat mount assembly received telescopically within the upper end of said seat support shaft assembly.

2. A vertically adjustable seat bracket as claimed in claim 1, in which said deck mount assembly includes an elongated guide member of V-shaped cross-section, which guide member extends entirely below the upper surface of said deck, and which guide member contains a bayonet locking aperture near its upper end just below said deck.

3. A vertically adjustable seat bracket as claimed in claim 1, in which said seat support shaft assembly includes a locking pin mounted across its diameter at the lower end of said shaft and extending through an aperture in one wall thereof externally of said shaft, and a sleeve member mounted at the opposite, upper end of said shaft, said sleeve having longitudinally extending notch on the inner surface thereof, parallel to the axis of said shaft, said notch starting at the top of said sleeve and terminating in a bayonet locking notch at the bottom thereof.

4. A vertically adjustable seat bracket as claimed in claim 1, in which said seat mount assembly includes a horizontal plate for attachment to a seat cushion bottom, a vertical seat shaft secured to the center of said horizontal plate and extending downwardly therefrom, a locking pin embedded in the side of said seat shaft near the lower end thereof and extending externally from said seat shaft perpendicular to the axis thereof, and a coil spring member secured to the lower side of said horizontal plate and encircling the upper end of said seat shaft.

* * * * *